United States Patent [19]

Scheller

[11] Patent Number: 4,562,989

[45] Date of Patent: Jan. 7, 1986

[54] APPARATUS FOR CONSTRUCTION OF CONCRETE WALLS

[75] Inventor: Herman Scheller, Barrington, Ill.

[73] Assignee: Peabody Continental-Heine Co., Des Plaines, Ill.

[21] Appl. No.: 657,111

[22] Filed: Oct. 2, 1984

[51] Int. Cl.[4] ..... E04G 11/20; E04B 1/16; E04B 1/04

[52] U.S. Cl. ..... 249/17; 249/19; 249/20; 425/65

[58] Field of Search ..... 249/10, 13, 17, 18, 249/19, 20; 425/63, 65

[56] References Cited

U.S. PATENT DOCUMENTS

| | | | |
|---|---|---|---|
| 1,030,480 | 6/1912 | Packard | 425/65 |
| 2,331,657 | 10/1943 | Erom | 425/63 X |
| 2,620,543 | 12/1952 | Scharsach | 425/65 |
| 3,252,199 | 5/1966 | Bössner | 249/17 X |
| 3,472,477 | 10/1969 | Juhl | 425/63 X |
| 3,521,336 | 7/1970 | Rohlf . | |
| 3,761,551 | 9/1973 | Ogata . | |
| 3,779,678 | 12/1973 | Scheller | 425/65 |
| 3,991,969 | 11/1976 | Oxyer | 249/10 X |
| 4,040,774 | 8/1977 | Scheller | 425/65 |
| 4,060,358 | 11/1977 | Fougea | 425/65 |
| 4,081,227 | 3/1978 | Bohmer et al. | 425/65 |
| 4,260,345 | 4/1981 | Pettersson | 249/20 X |

FOREIGN PATENT DOCUMENTS

| | | | |
|---|---|---|---|
| 902188 | 1/1954 | Fed. Rep. of Germany | 249/10 |
| 2504762 | 8/1975 | Fed. Rep. of Germany | 249/20 |
| 745718 | 2/1933 | France | 249/10 |
| 460665 | 12/1950 | Italy | 249/10 |
| 837036 | 6/1960 | United Kingdom | 249/10 |

*Primary Examiner*—J. Howard Flint, Jr.
*Attorney, Agent, or Firm*—Kirkland & Ellis

[57] ABSTRACT

A concrete forming system for constructing small diameter concrete columns with a refractory liner on the inside of the column wall. The present invention supports the inner and outer forms for the column wall on jacking frames which travel vertically on jacking beams attached to the wall. Loads created by plastic concrete are resisted by a system of radial supports which are attached to the inner concrete shaping forms and are supported by the jacking beams and jacking frames. After a portion of the column wall is poured, the next higher portion of the concrete column wall is formed by advancing the jacking frames and the concrete shaping forms upwardly along the jacking beams and reattaching lower sections of the jacking beams at the top of the jacking beams in order to provide a continuous track. The jacking frames and forms are raised on the jacking beams after a portion of the column wall is poured and the next higher portion of the concrete column wall is to be formed. The present invention also provides a similar radial supported form system enabling the refractory liner to be cast in place. Alternatively, a work platform is provided to enable a precast refractory liner to be installed.

23 Claims, 24 Drawing Figures

APPARATUS FOR CONSTRUCTION OF CONCRETE WALLS

BACKGROUND OF THE INVENTION

1. Field of the Invention

The present invention relates to concrete wall casting techniques utilizing pairs of spaced-apart shaping forms held in position by horizontal and vertical supports, the concrete being poured between the forms and on top of the section of wall poured earlier which has become at least partially set. After the most recently poured concrete partially sets, the forms are removed and relocated above the former position. The procedure is repeated until the wall is completed. More particularly, the present invention relates to improved movable supports for concrete shaping forms and apparatus for moving them which are adapted for forming small diameter columns.

2. Brief Description of the Prior Art

Related subject matter is disclosed and claimed in U.S. Pat. No. 3,779,678, issued Dec. 18, 1973, and U.S. Pat. No. 4,040,774, issued Aug. 9, 1977, both to the same inventor as the present invention. The above patents disclose techniques for constructing concrete chimneys, cooling towers and other columns having large diameters, typically in the range of greater than about sixty feet. Such techniques require the use of several heavy framing members on both sides of the concrete wall to accommodate the heavy loads created by the unset, plastic concrete.

The prior art jump-form chimney construction technique uses steel forms that are raised in increments of several feet for each pour. The forms are raised by a crew of workers using chain falls connected to overhead beams on a derrick, which is a structure that incorporates a work deck and is hung by cables from the inside of the concrete column. For each new pour, the derrick is raised using chain falls and reattached by cables to the concrete structure. Then the outside forms are raised, as one piece. Reinforcing steel is secured and the inside forms are raised, again as one piece. After alignment and plumb are checked, the concrete is poured. Taper and wall thickness are adjusted by changing the circumference of the forms.

The prior art slip-form chimney construction technique provides a method for constructing a concrete column monolithically. During construction, concrete is poured continuously into about four-foot-high forms that are steadily raised or "slipped" up the concrete structure using hydraulic jacks. The steady upward progress of the forms is timed so that the concrete is cured before the bottom of the form slips by. This method of construction is well suited for projects where time is of critical importance. It also has proved economical for structures of large diameters and for chimneys of extreme height. However, prior art slip forming techniques also involve very heavy and bulky form structures.

The large size and weight of the shaping forms and their support structure utilized in the foregoing techinques make them unsuitable for casting smaller towers having diameters of about 5 to 30 feet. In addition, the prior art techniques do not include any forming apparatus for casting in place an inner, acid-resistant refractory lining for the column at the same time the concrete column wall is being poured.

An object of the present invention is to eliminate the need for pairs of heavy frame members (one on each side of the wall) to transfer loads created by plastic concrete by replacing them with an inner frame with multiple central stiffeners. It is also an object of this invention to use a novel system of supports which moves the frame and forms into place by hydraulic jacks. A further object of this invention is to provide shaping forms and support structure for casting in place a refractory lining on the inside of the concrete column wall at the same time the column wall is being poured. It is a further object of an alternative embodiment of the present invention to provide an apparatus for using precast refractory panels as the inside shaping form for the concrete wall. Finally, it is an object of another alternative embodiment of this invention to provide a work platform for installation of an inner refractory lining after the concrete wall has been poured.

SUMMARY OF THE INVENTION

The present invention provides a new and improved apparatus for the efficient casting of shaped, concrete walls. The preferred embodiment includes a plurality of spaced-apart vertically upright supports, hereinafter referred to as jacking beams, extending initially from the foundation and then attached to the inside of the wall being formed of the wall. Sections of each jacking beam are detached from the bottom of the jacking beam and from the wall and re-attached at the upper end of the jacking beam to form a continuously advancing support system.

Mounted on this system of jacking beams are a plurality of jacking frames. The jacking beams and jacking frames carry inner and outer concrete shaping forms for the inside and outside surfaces of the colum wall. Each concrete shaping form comprises, in the preferred embodiment, a flexible sheet backed by vertical and horizontal supports with means for varying the position of each form.

Lateral support for the jacking frame is provided by two levels of center stiffener rings which are connected to the jacking frames and jacking beams by a plurality of radial bars mounted partially inside work deck brackets and adjusted by means of radius adjustment brackets.

Lateral support for the inner concrete shaping form is provided by the radial bars and center stiffener rings. A plurality of vertical beams that are attached to the inside concrete shaping form transfer lateral loads to the radius adjustment brackets by means of horizontal connectors, threaded adjustable rods, and scaffold boards which bear against the radius adjustment brackets. As an alternative embodiment, the inner concrete shaping form is constructed of precast panels of a material suitable for providing a refractory lining. These panels are anchored in place as an inner lining outer wall after the wall has been poured.

Lateral support for the outer concrete shaping form is provided by bonds which are located around the outside circumference of the outer concrete shaping form. An inside work scaffold is constructed above both levels of the lateral support system. An outside work scaffold with top and bottom levels is suspended from the outer concrete shaping form.

The inner concrete shaping form is attached to the jacking frames by the lateral support system. The outer concrete shaping form is suspended from the jacking forms. Also suspended from the jacking frame is a forming system for pouring a refractory wall against the inner wall of the chimney. Lateral loads on the refractory wall forming system are transferred in a manner analogous to the manner in which lateral loads are transferred from the inner concrete shaping forms. A plurality of vertical beams transfer lateral loads to horizontal connectors, threaded adjustable rods, scaffold board clips and scaffold boards, which bear against radius adjustment brackets. Loads are then transferred from the radius adjustment brackets to the center stiffener rings.

This invention provides for upward movement of all the jacking frames and form structure in unison at a selected rate on the jacking beams following the completion of the pour of the previous section of the wall. The jacking frame travels upward by means of jacking wheels which are mounted in jack frame supports to prevent lateral or radial movement. Upward thrust is provided by one or more hydraulic cylinders connecting the vertical jacking frame to the upper jack frame support. Jacking lugs, mounted in the upper jack frame support and the lower jack frame support and controlled by torsion springs, engage the exposed top surface of bars that are attached to the inner surface of the jacking beam. The lower jack frame support is rigidly connected to the jack frame by inner and outer knee braces, and travels upward as an integral part of the jack frame. The dimensions of the wall can be adjusted by varying the radius adjustment brackets and the threaded adjustable rods.

The jacking frame provides multiple levels of structure for construction operations. An upper level is used to set reinforcing bar and to place the concrete; the next highest level is used to set forms for the concrete column wall.

The refractory wall forming system, which is suspended below the jacking frames, provides two additional levels, at each of which a working platform is supported. The upper refractory level is used to place the refractory wall; the lower refractory level is used to set the refractory wall lining forms. In an alternative embodiment, the refractory wall can be constructed of precast panels which form the refractory wall forming system.

DESCRIPTION OF THE DRAWINGS

FIG. 6 is a front view of an outer form sheet;

DESCRIPTION OF THE PREFERRED EMBODIMENT

Figure 1:
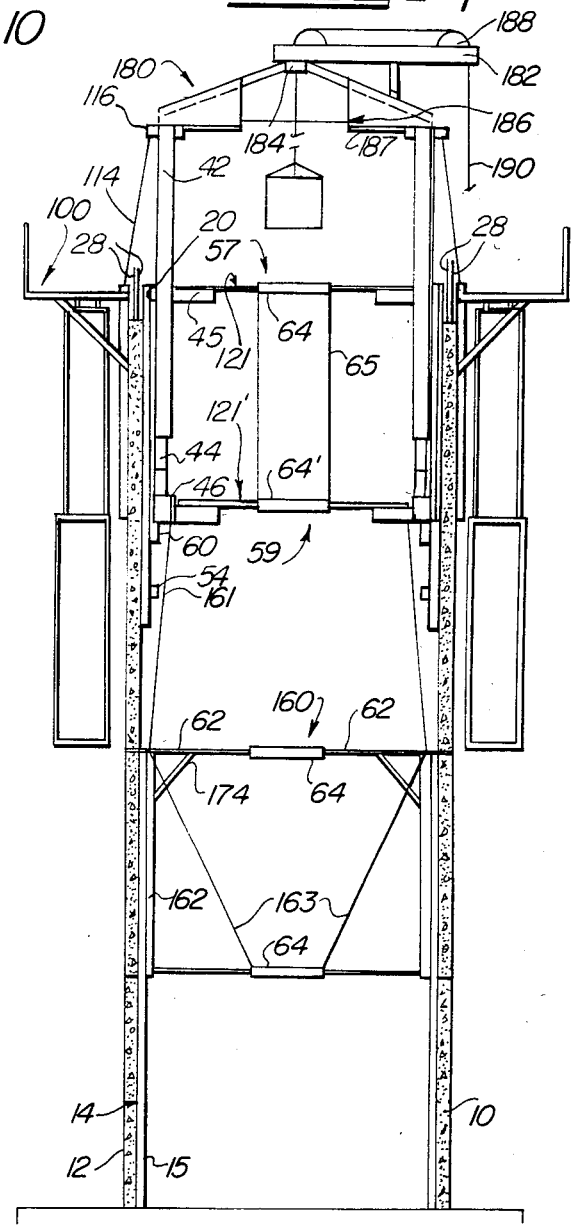
FIG. 1 is a section view of the apparatus of the present invention in place on a wall being constructed.

The preferred embodiment of the apparatus is set forth herein, for illustrative purposes, in connection with the construction of a concrete veil or outside wall of a natural draft chimney having a diameter of from about 5 to 30 feet. In this construction, the round concrete wall may decrease in diameter as it rises toward the top. As illustrated in FIG. 1, the tower wall 10 has an outer surface 12 and an inner surface 14. Also, a wall may have an inner refractory lining 15 adjoining and attached to the inner surface 14 of the wall.

Figure 3:
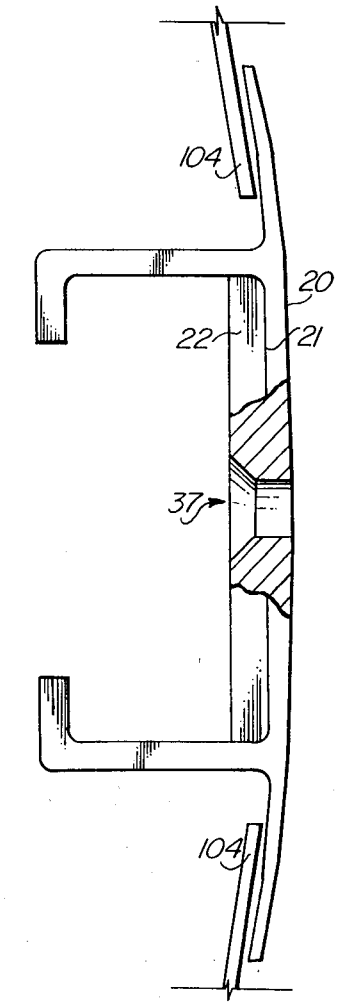
FIG. 3 is a section view of a jacking beam of the present invention.
Figure 2:
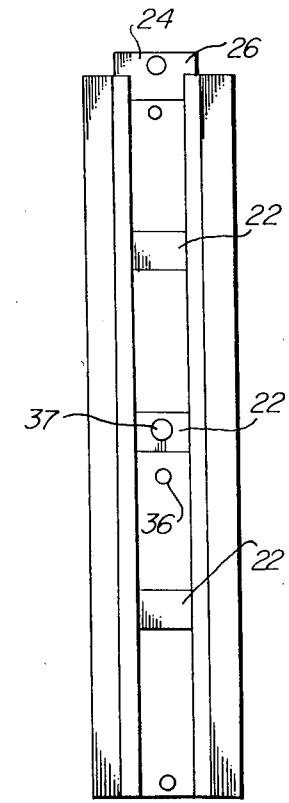
FIG. 2 is an elevation view of a jacking beam.
Figure 21:
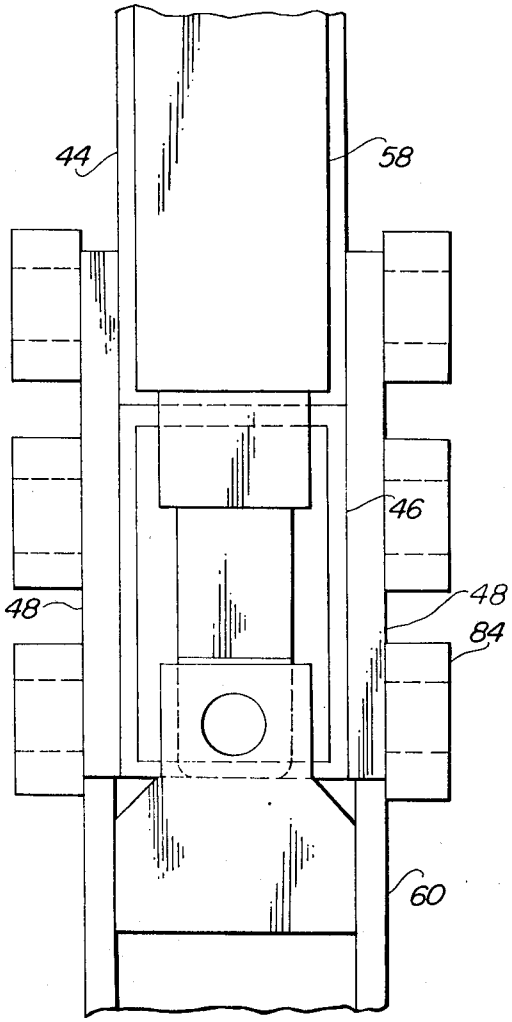
FIG. 21 is a front view of the connection between the jacking frame and the upper jack frame support.

During the initial construction of a chimney and after the ground foundation has been laid, a plurality of spaced-apart, vertical jacking beams 20, as shown in FIGS. 1 2 and 3 are anchored in the foundation. In the preferred embodiment the beams 20 are constructed of extruded aluminium, generally with a cross section as shown in FIG. 3. As shown in FIGS. 2 and 3, each beam has a plurality of flat bars 22 configured to be attached to the inside surface 21 of the jacking beam 20. In order to form multi-level vertical supports, individual beams 20 are attached at their ends by a flat plate 24 and flat head screw 26.

Figure 4:
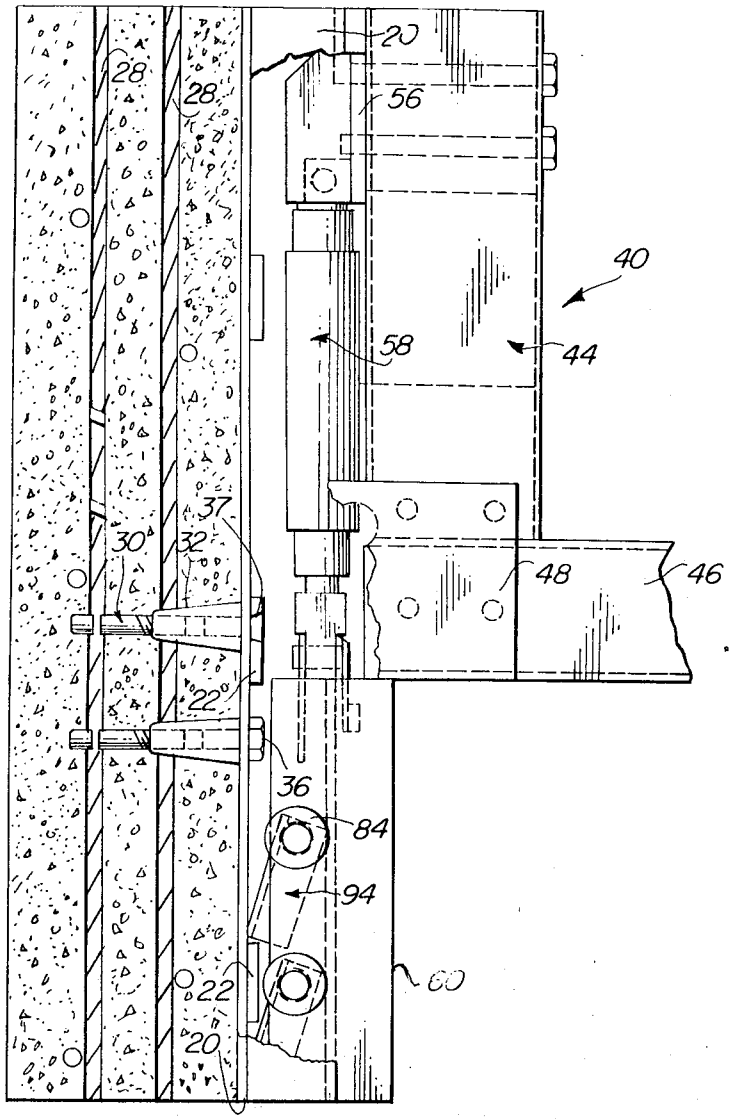
FIG. 4 is an enlarged, fragmentary side elevation of the connection between a jacking frame and a jacking beam in the apparatus of the present invention.

As shown in FIG. 4, prior to pouring concrete, the jacking beam 20 is connected to reinforcing steel 28 for wall 10 by means of jacking beams fasteners comprising J-bolts 30, insert cones 32, hex head embedment screws 36 and flat head embedment screws 37. When the concrete is poured, the J-bolts 30 remain embedded in the concrete wall 10.

Figure 12:
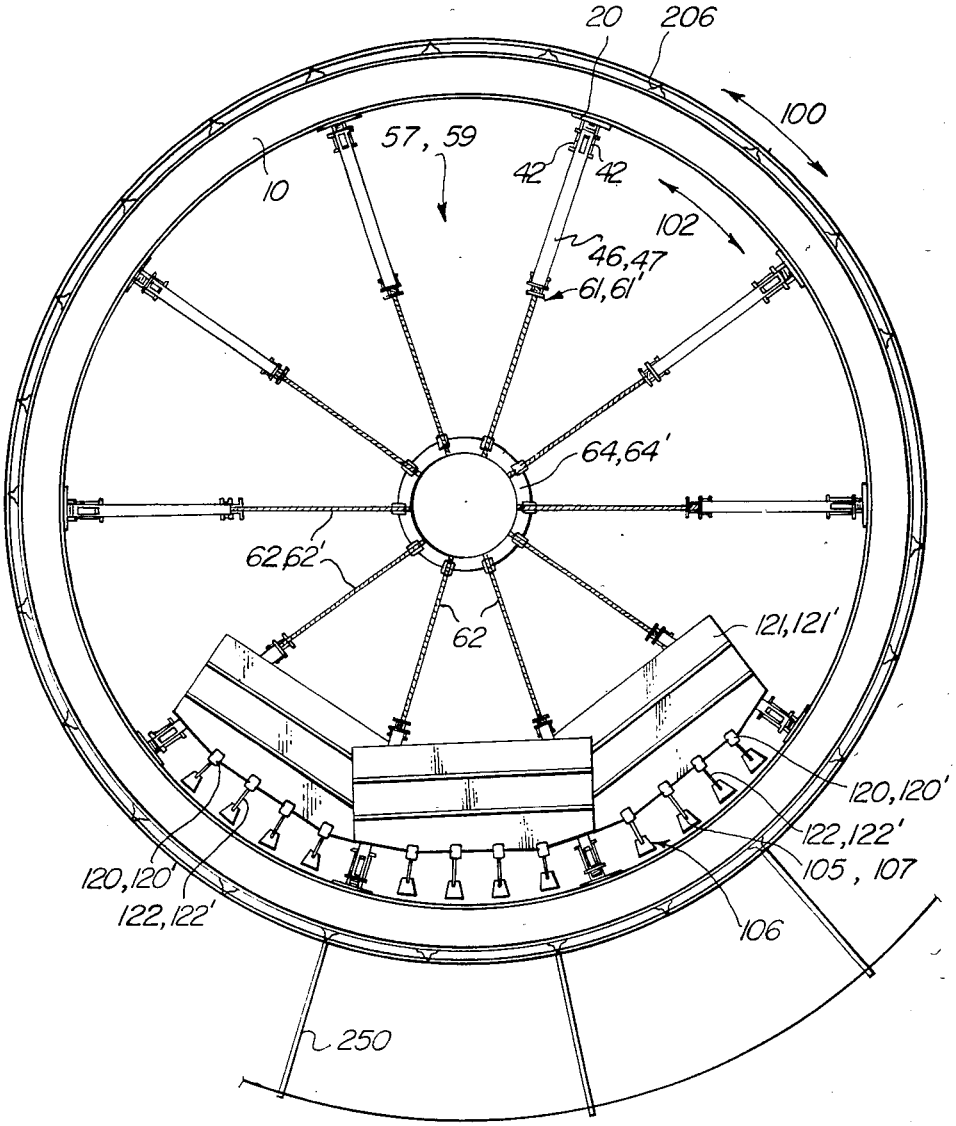
FIG. 12 is a top view of the lateral support system.

As illustrated in FIG. 12, each jacking beam 20 is separated from similar beams around the inside surface 14 of the wall 10 so that the jacking beams 20 are located at spaced intervals completely along the inner wall surface 14. As the concrete is poured, and the wall 10 increases in height, the lowest jacking beam 20 is separated from the beam 20 below it by removing screw 26 and is detached from the side of the wall by removing the screws 36 and screws 37, leaving the J-bolts 30 and insert cones 32 in the wall. The insert cones 32 are subsequently removed for re-use. The lowest jacking beam 20 is then similarly attached as the top jacking beam 20. Lower jacking beams 20 are connected to sections of the wall 10 that have cured sufficiently to support the jacking beams 20 and other structures mounted on them.

Figure 5:
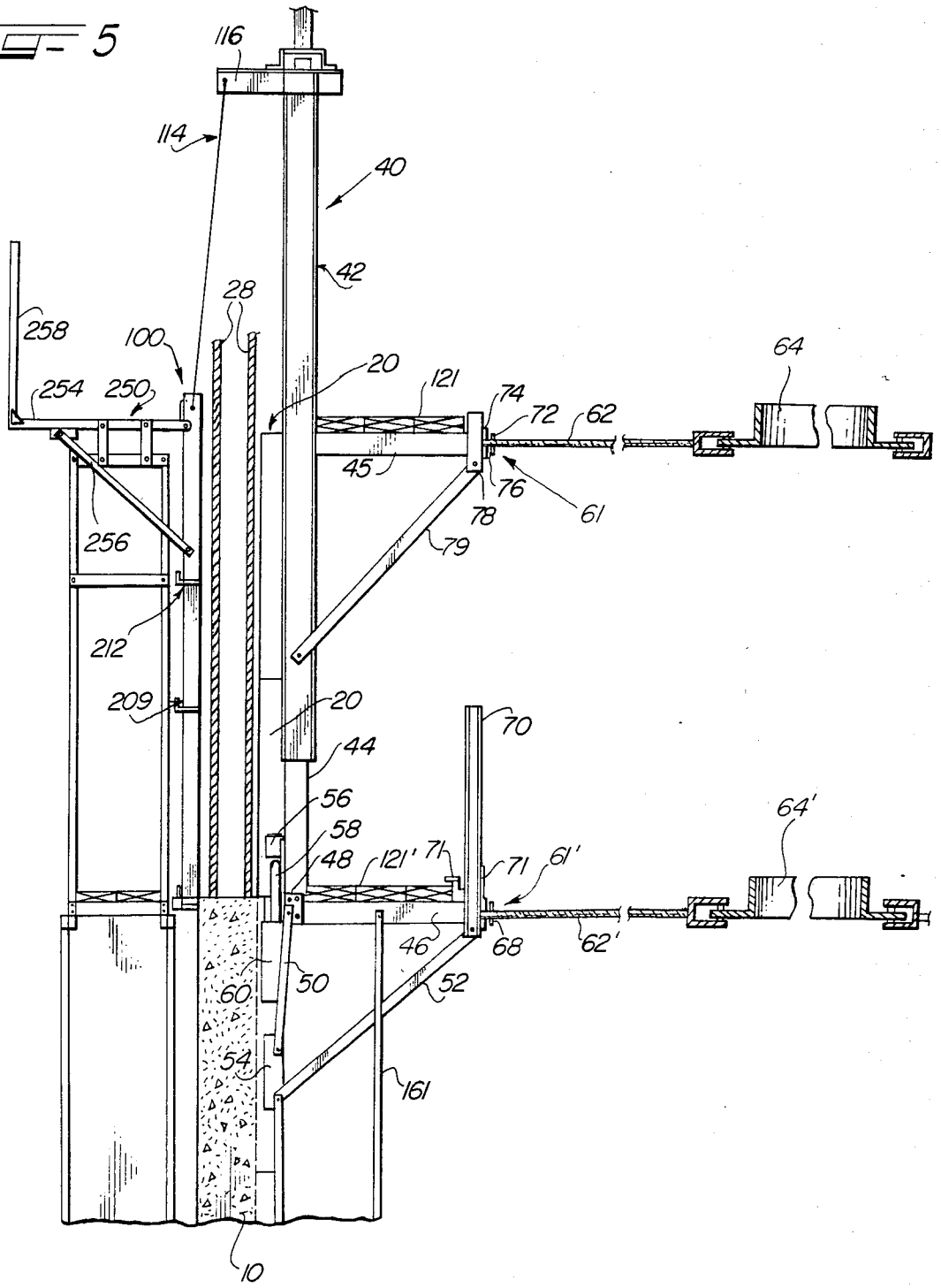
FIG. 5 is a vertical section of the apparatus showing the preferred form of the jacking frame.
Figure 9:
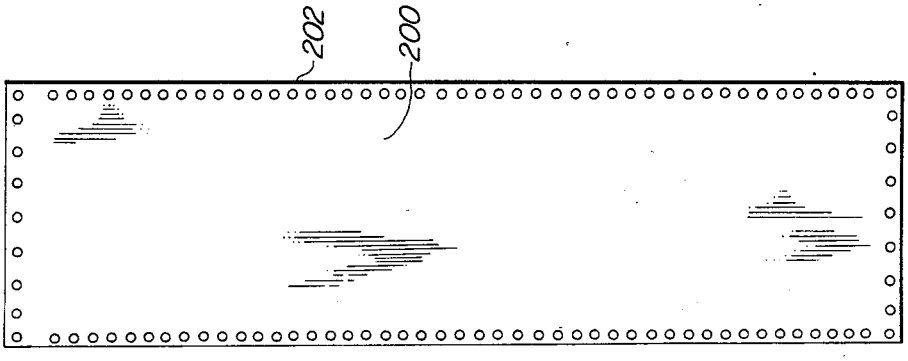

Mounted on each jacking beam 20 is a vertical jacking frame 40 as shown on FIG. 5. Each jacking frame consists of back-to-back channel members 42, structural tube 44, top work deck bracket 45, top hand rail post 78, top work deck 121, top knee brace 79, bottom work deck support bracket 46, bottom hand rail post 70, bottom work deck lug 66, lower scaffold boards 121, bottom knee brace 52, inner braces 50, upper jack frame support 60, lower jack frame support 54, jack bracket 56, hydraulic cylinder 58, and splice plates 48.

Attached to the vertical jacking frame 40 is an outer concrete shaping form 100 and an inner concrete shaping form 102. As shown in FIG. 5 and FIG. 6 the outer concrete shaping form 100 is suspended from jacking frame cross piece 116 by cables 114 and is composed of a plurality of outer form sheets 200. The outer form sheets 200 in the preferred embodiment are approximately 10.5 feet tall and 3 feet wide. Holes 202 are predrilled in the outer form sheets 200 for the purpose of attaching adjoining outer form sheets 200.

Figure 9:
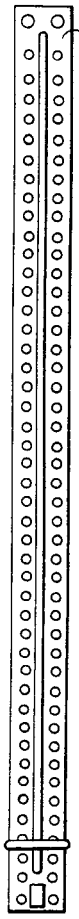
FIG. 9 is a front view of an outer form splice tee.
Figure 10:
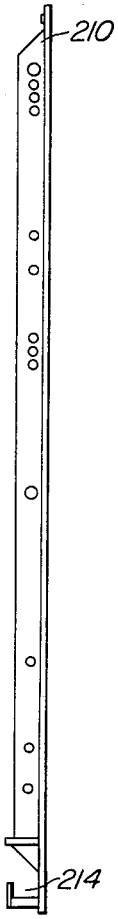
FIG. 10 is a side view of an outer form splice tee.
Figure 8:
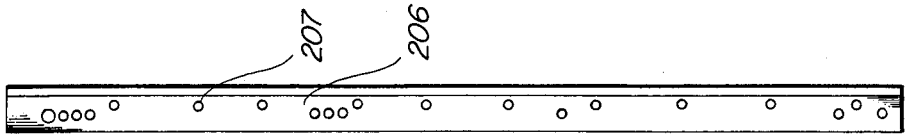
FIG. 8 is a side view of an outer form splice angle brackets.
Figure 7:
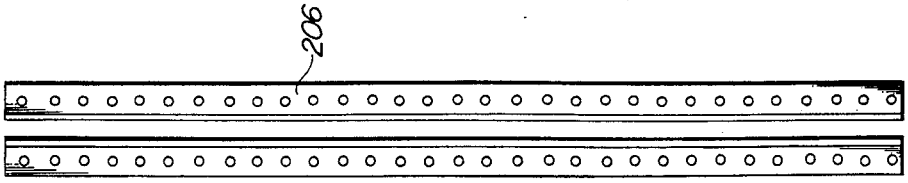
FIG. 7 is a front view of a pair of outer form splice angle brackets.

As shown in FIGS. 7 and 8, outer form sheets 200 are attached to adjoining form sheets 200 by outer form splice angle brackets 206 to form a continuous ring around the circumference of the wall to be poured. Additional holes may be drilled into one or more outer form sheets 200, designated as outer form lap sheets (not shown), in order to accommodate changes in circumference. Each outer form lap sheet is connected to adjoining outer form sheets 200 by an outer form splice tee 210 as shown in FIGS. 9 and 10.

As shown in FIG. 5, outside work frame 250 is attached to the outer concrete shaping form 100. The outside work frame 250 consists of an outside work deck 252, outside work deck beams 254, outside work deck hangers 256, and outside work deck knee brackets 258.

Figure 11:
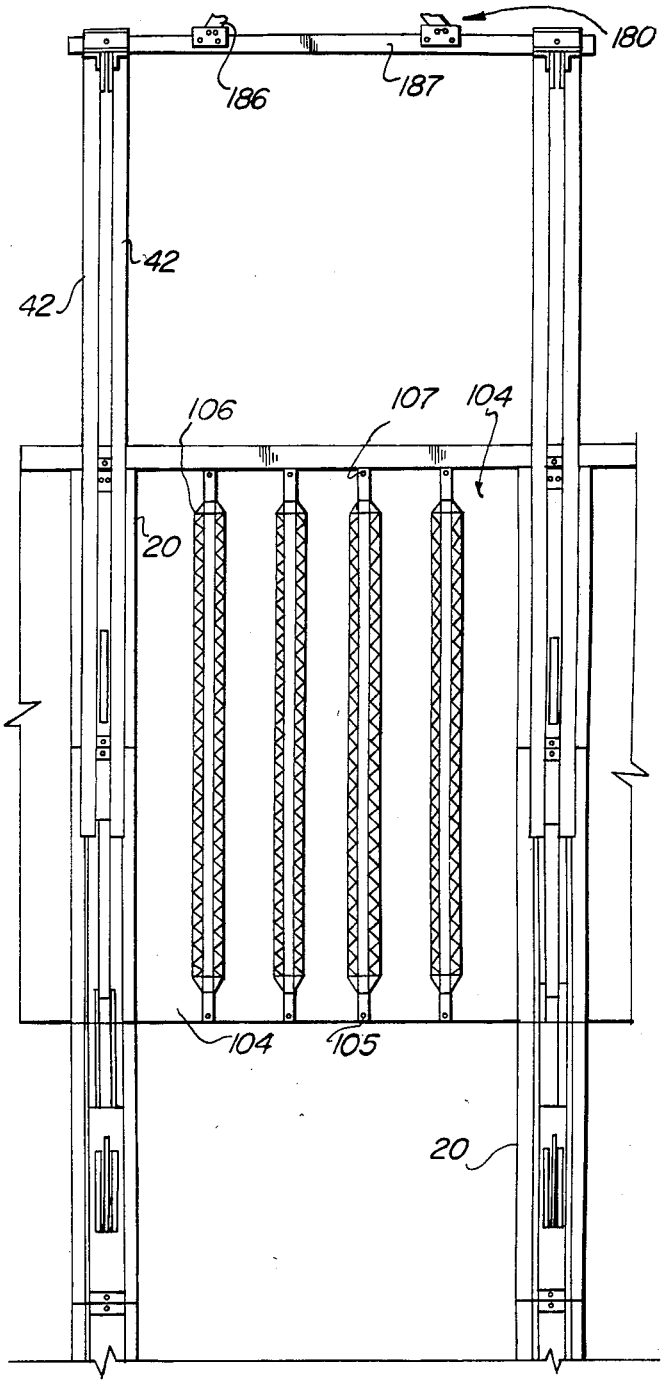
FIG. 11 is a front view of the inner form assembly.

The inner concrete shaping form 102, as shown in FIG. 11, consists of a plurality of inner form sheets 104 which span between adjacent jacking beams 20. As shown in FIG. 3, the outer flange of jacking beam 20 and the inner form sheets 104 overlap to provide a continuous surface against which plastic concrete is poured. Each inner form sheet 104 is connected to the jacking frame 40 by the lateral support system 57, 59 shown on FIG. 12. A plurality of vertical support beams 106 are attached to each inner form sheet 104. Attached to both ends of the vertical support beam 106 are horizontal threaded connectors, a top connector 107 and a bottom connector 105.

As shown in FIG. 1, the jacking frame 40 also supports a refractory wall shaping form 160. The refractory wall shaping form consists of refractory wall sheets 162 which are similar to the inner form sheets 104 shown in FIG. 14. The refractory wall shaping form 160 is supported by tension connectors 161 from the jacking frame 40. Stability is also provided by stabilizers 163. The refractory wall shaping assembly 160 is analogous to the inner form assembly 102 as shown in FIG. 11, with the exception that the jacking beam 20 may be replaced by a wide flange beam of standard design. In an alternative embodiment, the inner concrete shaping form is constructed of precast panels of a material suitable for providing a refractory lining. These panels are anchored in place as an inner lining wall after the outer wall has been poured.

Figure 19:
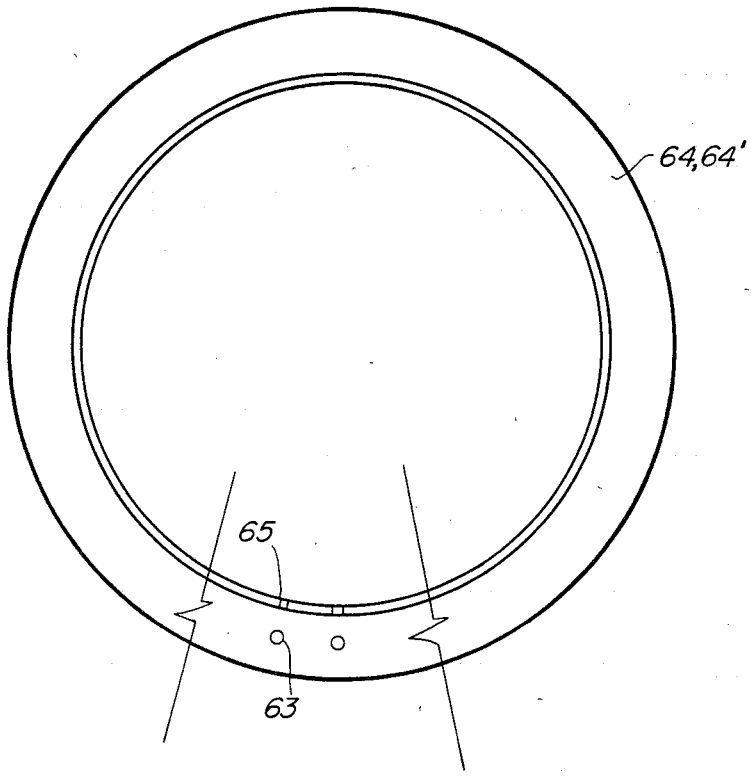
FIG. 19 is a top view of a center stiffener ring.

In the preferred embodiment, the inner form sheets 104 and outer form sheets 200 and sheets in the refractory wall shaping form are flexible sheets which are constructed of sheets of two materials bonded together. A plastic laminated material is placed on the side of the form against which the concrete is poured. The plastic sheet is then bonded to a mild steel sheet to form the flexible sheet. In the preferred embodiment ring 64, 64' as shown in FIG. 19, is constructed from a structural angle, an angle with an L-shaped cross-section. The center stiffener ring 64, 64' has predrilled vertical holes 63 and horizontal holes 65 for connection to other members.

Figure 14:
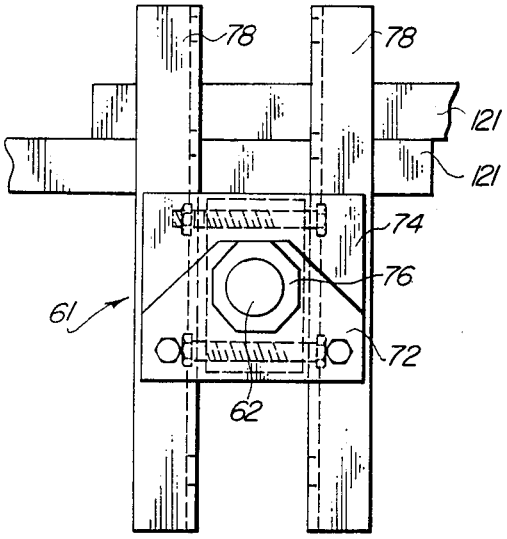
FIG. 14 is an end view of the top radius adjustment bracket.
Figure 15:
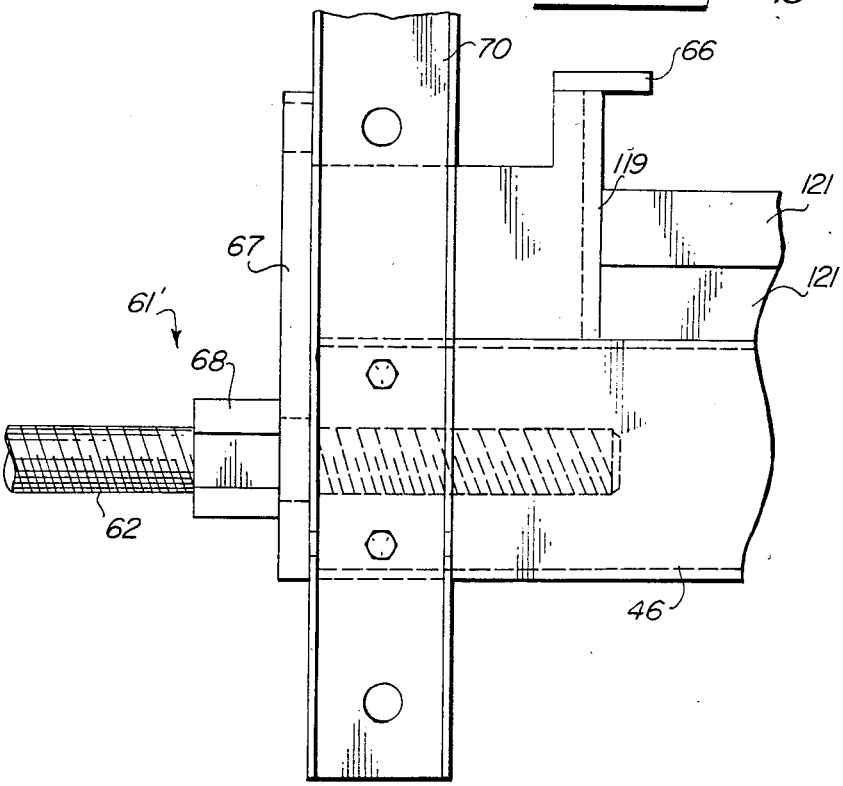
FIG. 15 is a section view of the bottom radius adjustment bracket.
Figure 17:
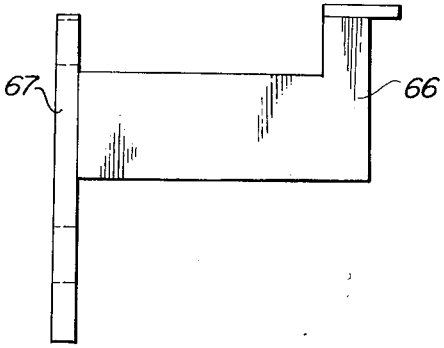
FIG. 17 is an elevation view of a work deck lug.
Figure 16:
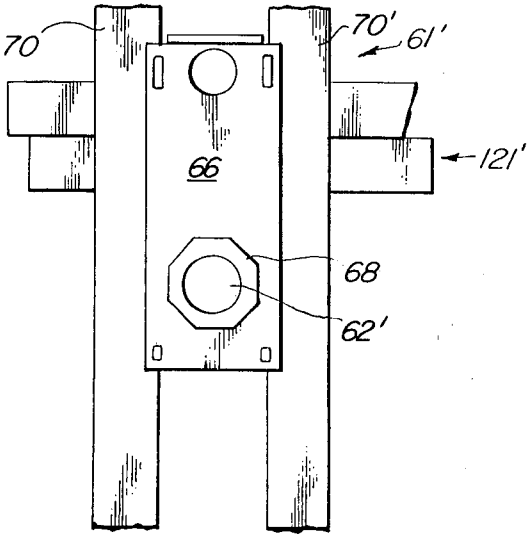
FIG. 16 is an end view of the bottom radius adjustment bracket.

Lateral loads on the jacking frame 40 are carried by the lateral support system 57, 59. As shown in FIG. 1, the lateral support system has two levels, a top level 57 and a bottom level 59. FIG. 12 shows a schematic of the lateral support system which comprises both the top level or bottom level lateral support system 57, 59. FIG. 12 shows a central stiffener ring 64, 64' threaded radial bars 62, 62' radius adjustment brackets 61, 61', work deck support members 45, 46, work deck 121, 121' work deck clips 120, 120' and threaded adjusting bars 122, 122'. As shown in detail in FIGS. 13 and 14, the top lateral support system 57 includes a center stiffener ring 64, threaded radial bars 62 and a radius adjustment bracket 61, comprising a forward radius adjustment plate 72, rear radius adjustment plate 74 and hex nut 76. As shown in FIGS. 15, 16 and 17, the bottom lateral support system includes a center stiffener ring 64, threaded radial bars 62', and a radius adjustment bracket 61' including bottom work deck lugs 66, and hex nuts 68. As shown in FIG. 1, the top and bottom center stiffener rings 64 are connected by vertical supports 65.

Lateral loads on the refractory wall shaping form 160 are carried by a two-level support system similar to that shown in FIG. 12. As shown in FIG. 1, the top refractory wall shaping form 160 includes refractory wall sheets 162, knee braces 174, and stabilizers 163.

Tension is placed on the outer concrete shaping assembly 100 by means of belly bands 209. As shown in FIG. 5, belly bands 209 are supported by belly band support brackets 212 which are attached to the outer form splice angles 206 and outer form splice tee 210. Additional support for belly bands 209 is provided by bracket 214 in the outer form splice tee 210 as shown in FIG. 10. Tension is adjusted by means of standard devices well known in the art.

Lateral loads produced by pouring concrete into the mold formed by the inner and outer concrete shaping forms 102, 100 are transferred to the center stiffener rings 64' by the lateral support system 57, 59. Lateral loads originate from the surfaces in contact with the plastic concrete. As shown in FIG. 3, those surfaces are the outer surface of the flange of jacking beam 20 and the outer surface of inner concrete form sheets 104.

On the bottom level 59, lateral loads from the jacking beam 20 are transferred from the jacking beam 20 to splice plate 48 to the bottom deck support member 46 and bottom hand rail posts 70, as shown in FIGS. 5, 15 and 16. Lateral loads on the hand rail post 70 are transferred to the front plate 67 of the work deck lug 66, the threaded radial bars 62' and the center stiffener ring 64'.

Figure 13:
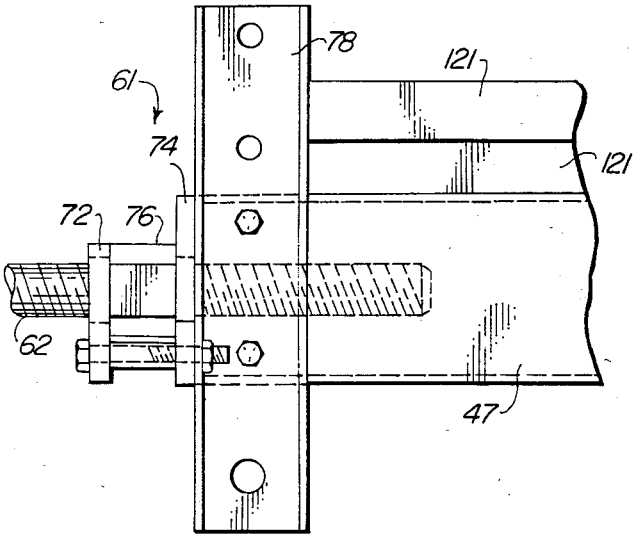
FIG. 13 is a section of the top radius adjustment bracket.

Lateral loads are transferred from the jacking beam 20 to the center stiffener ring 64 on the top level by a similar method. As shown in FIGS. 5, 13 and 14, lateral loads are transferred by the top work deck bracket 47 to the upper hand rail post 78. As shown in FIGS. 13 and 14, lateral loads on the top hand rail posts 78 are transferred to the rear radius adjustment plate 74, hex nut 76, front adjustment plate 72, threaded radial bars 62 and central stiffener ring 64.

Lateral loads originating between the jacking beams 20 on the inner concrete shaping form 102, are transferred by a different path. As shown schematically in FIG. 12, lateral loads on the bottom level are transferred to a center stiffener ring 64' by lower horizontal connectors 105, threaded adjusting bars 122', lower work deck clips 120', and work deck 121'. As shown in FIGS. 15 and 16, the inner edge 119 of work deck 121' bears against the work deck lug 66 which transfers that load to the forward plate 67 of the work deck lug 66 and from there to a threaded radial bar 62' and center stiffener ring 64'.

Figure 18:
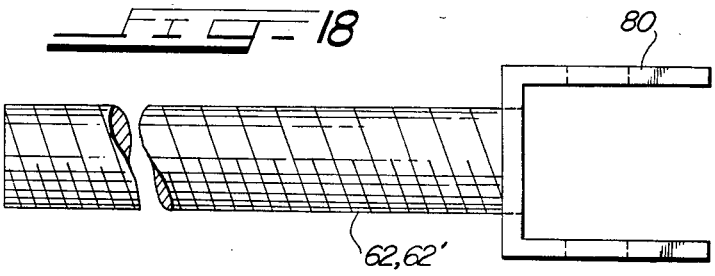
FIG. 18 is a cross-section view of a threaded radial bar.
Figure 20:
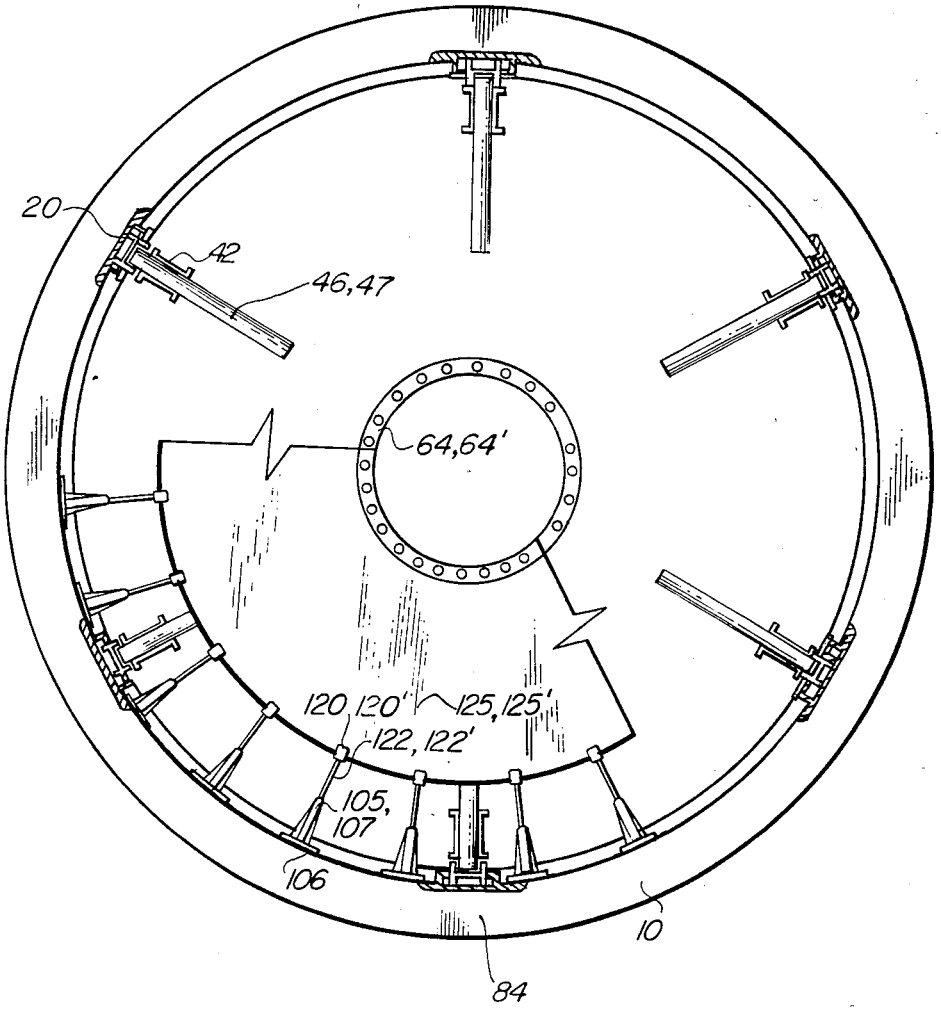
FIG. 20 is a top view of an alternative lateral support system.

Lateral loads originating between the jacking beams 20 are transferred to a center stiffener ring 64 on the top level in a similar manner. As shown schematically in FIG. 12, top horizontal connectors 107 are connected to threaded radial adjusting bars 122, work deck clips 120, and work deck 121. As shown in FIGS. 13 and 14, the inner edge 119 of scaffold 121 bears directly against upper hand rail post 78 which transfers lateral loads through the front plate 74, hex nut 76 and rear plate 72 to threaded radial bars 62. As shown in FIG. 12, the threaded radial bars are connected to central stiffener ring 64. As shown in FIGS. 18 and 19, a threaded radial bar 62 is connected to vertical holes 63 in a center stiffener ring 64 by a yoke and pin connection 80. An alternative embodiment of a top or bottom lateral support system is shown in FIG. 20. Instead of transferring lateral loads on the inner concrete form sheets 104 from the work deck 121 to the center stiffener ring 64 by means of threaded radial bars 62 as shown in FIG. 12, such loads are transferred to the center stiffener ring 64 by a connection between the ring 64 and the work deck 121. In this embodiment, the top work deck support bracket 47 and bottom deck support bracket 46 can be retained and radial bars 62 and 62' can be deleted. This embodiment can also be used to support lateral loads on the refractory wall shaping form 160.

Figure 24:
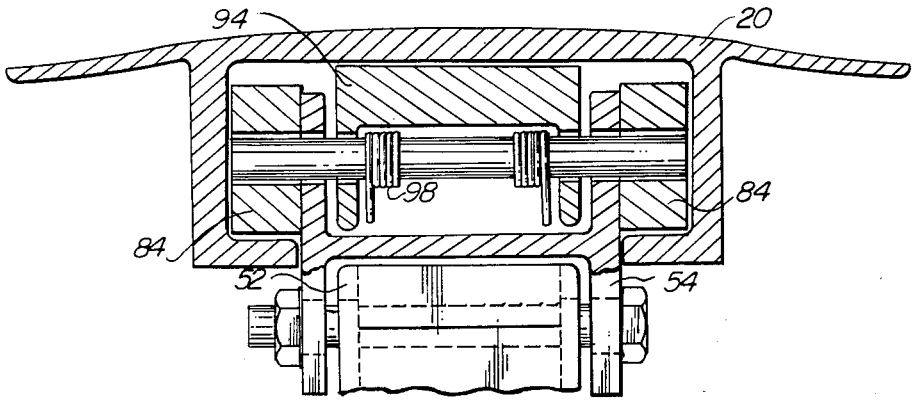
FIG. 24 is a detailed view of the lower jack connection between the jacking beam and the frame support.
Figure 23:
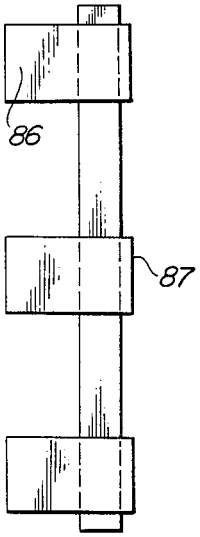
FIG. 23 is a fragmentary view of the dowel connection between a splice plate and jacking wheels.
Figure 22:
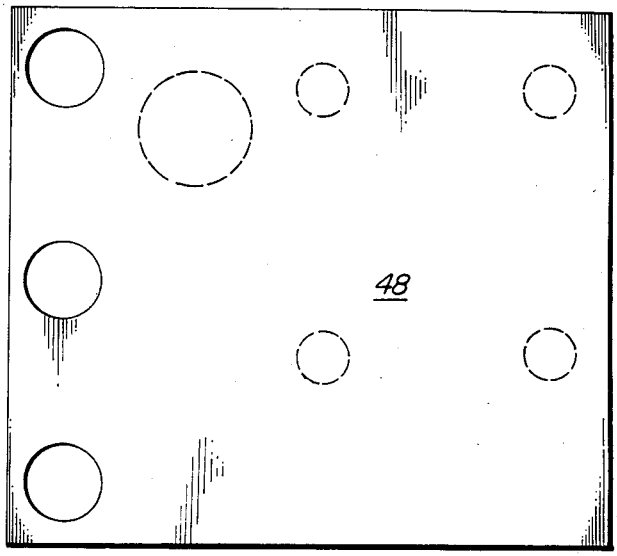
FIG. 22 is a section view of a splice plate.

The jacking frame 40 is connected to the jacking beam 28 by a plurality of jacking wheels 84. Jacking wheels 84 run axially inside jacking beam 20 as shown in FIG. 24. As shown in FIGS. 22 and 23, jacking wheels 84 are attached to splice plates 48 by dowels 86 mounted on dowel frames 87 and run inside jacking beam 20. As shown in FIG. 24, lower jack frame support 54 has jacking wheels 84 which run inside jacking beam 20. Attached to the jacking wheels 84 in the upper and lower jack frame supports 54 and 60 are jacking lugs 94 and tension springs 98. The upper jack frame support 60 has jacking wheels 84 which run inside jacking beam 20 in a manner analogous to that in the lower jack frame 54.

As shown in FIG. 4, the jacking frame 40 travels upwards by means of the thrust provided by the hydraulic jack 58 as it expands against the upper jack frame support 60 by means of hydraulic pressure supplied to the jack 58 through a flexible hose (not shown). The upper jack frame support 60 and jacking lugs 94 remain in place as the cylinder 58 begins to expand. However, the lower jack frame support 54, as shown in FIG. 5, disengages and travels upward along with the jacking frame 40. Inner brace 50 then positions lower jack frame support 54 so that jacking lugs 94' may engage a higher bar 22 on jacking beam 20 in a manner analogous to the engagement action in the upper jack frame support 60. As shown in FIG. 4, the jacking lugs 94 are forced into place and retained there by tension spring 98.

In casting the initial courses of the wall, an ordinary general crane (not shown) is used to raise the plastic concrete from the ground to the forms around the periphery of the wall 10. As shown in FIG. 1, when the height of the structure exceeds the reach of the crane, a cathead crane 180 is attached to the top of the frame to provide the means to transport plastic concrete and other materials to the work area. Thus, the necessity for using a large tower crane is avoided and the work can progress much more quickly. In addition, the support for the crane provides additional lateral support for jacking beams and jacking frames. As shown in FIG. 1, the cathead crane 180 is composed of a beam 182 which is bolted to a top block 184 supported by four legs 186 beams 187. On the upper side of the beam 182, two sheaves 188 are attached. A commercial hoisting engine (not shown) is placed on the ground so that a load line 190 originating with the hoisting engine on one side of the wall 10 is supported over the wall on the sheaves 188 so that materials can be hoisted from the ground to the top of the column.

While the preferred embodiment of the invention has been illustrated and described, it is to be understood that the invention is not limited to the precise construction therein disclosed and the right is reserved to all changes and modifications coming within the scope of the invention as defined in the appended claims.

I claim:

1. Apparatus for constructing a concrete wall comprising:

a plurality of generally vertical jacking beams spaced apart along the inside of the wall being formed, each jacking beam comprising at least two separate sections detachably joined together at their ends;

a plurality of jacking beam fastener means for detachably connecting and reconnecting said jacking beams to the wall, wherein at least some of the fastener means are contained in the wall previously formed, and wherein the lower portion of each jacking beam is held by the jacking beam fastener means contiguous to the surface of the wall previously formed while the upper portion of the jacking beam extends above the portion of the wall previously formed;

a plurality of jacking frames, one jacking frame being mounted on each jacking beam;

jacking means for advancing each of the jacking frames upwardly along the jacking beams as the wall is formed;

an inner concrete shaping form supported by the jacking frames and positioned along and on the inside of the wall being formed adjacent its top; an outer concrete shaping form suspended from the jacking frames and positioned along and on the outside of the wall being formed adjacent to its top; the inner and outer concrete shaping forms being supported solely by the jacking frames, each of the inner and outer concrete shaping forms having a generally vertical casting surface to define a continuous mold on top of the previously poured portion of the wall into which concrete is poured, whereby as the concrete hardens the jacking frames and inner and outer concrete shaping forms are moved upwardly on the jacking beams to form a new level of wall and, at intervals, lower sections of the jacking beams are detached from the bottom of each jacking beam and attached to the top thereof to provide a continuous track for the jacking frames;

at least one central structural member for providing radial support; and radial support means for transferring lateral loads from said inner and outer concrete shaping forms to the central structural member, wherein the inner concrete shaping forms, the jacking beams, the jacking frames, the central structural members and the radial support means cooperate to resist lateral movements.

2. The apparatus defined in claim 1 further comprising hoisting means attached to said jacking frames for raising materials from ground level to the level of said inside and outside concrete shaping forms.

3. The apparatus defined in claim 2 wherein said hoisting means further comprises a ground supported hoisting engine, a hoisting cable and a stationary cable supported from a central loading point below said frames, from which point the hoisting cable is guided.

4. The apparatus defined in claim 1 wherein the inside surface of the inside shaping form is comprised of a plurality of precast refractory panels, wherein the refractory panels form the inside surface of the wall to be poured and provide a continuous inner wall lining.

5. The apparatus as claimed in claim 1 wherein said inside concrete shaping form is comprised of a plurality of panels and wherein said vertical supports include a member for engaging one form panel on either side thereby forming a continuous inner surface of the mold.

6. The apparatus defined in claim 1 further comprising a second inside shaping form supported from said jacking frames to provide a continuous mold around the inside surface of the poured wall into which an inner, refractory wall is poured.

7. The apparatus as claimed in claim 6 further comprising radial support members for resisting inward movement of said second inside shaping form.

8. The apparatus as claimed in claim 7 wherein said radial support members further comprise work deck members for providing a work area.

9. The apparatus as claimed in claim 1 further comprising:

a plurality of attachment means for attaching sections of the jacking beams to each other; and wherein each section of the jacking beams further comprises a plate member rigidly attached to one end thereof, each plate member having a hole for receiving one of the attachment means, and each section of each jacking beam also having a hole on the end opposite the plate member for receiving one of the attachment means, and wherein two segments are rigidly attached end-to-end by one of the attachment means in the two holes.

10. The apparatus as claimed in claim 1 wherein said vertical supports further comprise guide means for constraining lateral or radial movement of the jacking frames.

11. The apparatus as claimed in claim 9 wherein said jacking frames further comprise roller means, said roller means being adapted for axial movement within said guide means.

12. The apparatus as claimed in claim 1 wherein the sections of the jacking beams further comprise a plurality of vertically spaced-apart lug engaging members.

13. The apparatus as claimed in claim 12 wherein the jacking means for advancing the frame upwardly further comprises a plurality of lug means, each of said lug means being pivotably attached to the jacking frames and spring biased to engage the lug engaging members on the sections of the jacking beams, engagement of the lug means with at least one of the lug engaging members preventing vertical, downward movement of the jacking frames.

14. The apparatus as claimed in claim 13 wherein first and second the lug means are attached to each of the jacking frames such that when the jacking means is actuated, the jacking frame is supported by the first lug means and the second lug means is disengaged from one of the lug engaging members and advanced upward until it engaged the next of the lug engaging members, whereupon the jacking frame is supported against downward movement by the second lug means while the first lug means is disengaged from one of the lug engaging members and advanced upward until it engages the next of the lug engaging members.

15. The apparatus as claimed in claim 1 wherein the jacking beam fastener means are detachably attached means to the inside surface of the wall being formed.

16. The apparatus as claimed in claim 1 wherein said central structural member further comprises a circular ring.

17. The apparatus as claimed in claim 16 wherein one end of each of the radial support means is attached to the circular ring and the other end is attached to the inside concrete shaping form, the radial support means thereby extending radially between the circular ring and the inside concrete shaping form.

18. The apparatus as claimed in claim 17 wherein the radial support means further comprise radial adjustment means for adjusting the distance between the circular ring and the inside concrete shaping form.

19. The apparatus as claimed in claim 18 wherein the radial support means further comprise work deck members.

20. The apparatus as claimed in claim 1 further comprising a lower work platform supported by said jacking frames below said inside and outside concrete shaping forms.

21. The apparatus as claimed in claim 1 wherein said outside concrete shaping form further comprises horizontal, circumferential tension members bearing on the outside surface of said outside concrete shaping form.

22. The apparatus as claimed in claim 1 wherein said inside concrete shaping form further comprises vertical stiffener members bearing on the inside surface of said inside concrete shaping form.

23. The apparatus as claimed in claim 22 further comprising horizontal connector members, wherein said inside concrete shaping form is attached to said radial support members by said horizontal connector members.

* * * * *